US007476187B2

(12) United States Patent
Corte

(10) Patent No.: US 7,476,187 B2
(45) Date of Patent: Jan. 13, 2009

(54) STRENGTH ASSISTANT DEVICE AND METHODS

(76) Inventor: Steven A. Corte, 3354 Horrell Ct., Fenton, MI (US) 48430

( * ) Notice: Subject to any disclaimer, the term of this patent is extended or adjusted under 35 U.S.C. 154(b) by 251 days.

(21) Appl. No.: 11/177,510

(22) Filed: Jul. 8, 2005

(65) Prior Publication Data

US 2007/0010375 A1 Jan. 11, 2007

(51) Int. Cl.
*A63B 26/00* (2006.01)

(52) U.S. Cl. ..... 482/141; 482/62

(58) Field of Classification Search ..... 482/141, 482/62, 66, 32; 135/66–67
See application file for complete search history.

(56) References Cited

U.S. PATENT DOCUMENTS

| | | | | |
|---|---|---|---|---|
| 2,572,928 | A | 10/1951 | Hawes | |
| 2,932,510 | A | 4/1960 | Kravitz | |
| 4,153,244 | A | 5/1979 | Tauber, Jr. | |
| 4,241,914 | A | 12/1980 | Bushnell | |
| 4,258,915 | A | 3/1981 | Sellge, Jr. et al. | |
| 4,850,589 | A | 7/1989 | Block | |
| 4,902,002 | A | 2/1990 | Huang | |
| 5,135,458 | A | 8/1992 | Huang | |
| 5,334,121 | A | 8/1994 | McPhilomy | |
| 5,499,645 | A * | 3/1996 | Baliga | 135/67 |
| 5,536,222 | A | 7/1996 | Banda et al. | |
| 5,582,565 | A | 12/1996 | Soria | |
| 5,660,637 | A * | 8/1997 | Dodge | 118/500 |
| 5,697,875 | A | 12/1997 | Stan | |
| 5,718,344 | A * | 2/1998 | Joldeson et al. | 211/206 |
| 5,842,960 | A | 12/1998 | Yu | |
| 5,961,430 | A | 10/1999 | Zuckerman et al. | |
| 6,090,023 | A | 7/2000 | Liu | |
| 6,117,057 | A | 9/2000 | Olschansky et al. | |
| 6,168,548 | B1 * | 1/2001 | Fleming | 482/23 |
| 6,248,048 | B1 | 6/2001 | Zuckerman et al. | |
| 6,319,176 | B1 | 11/2001 | Landfair | |
| 6,409,640 | B2 | 6/2002 | Cournoyer | |
| 6,676,578 | B2 | 1/2004 | Lindqvist | |
| 6,692,417 | B2 | 2/2004 | Burrell | |
| 6,702,723 | B2 | 3/2004 | Landfair | |
| 2004/0097353 | A1 | 5/2004 | Mencis et al. | |
| 2004/0211275 | A1 | 10/2004 | Fich et al. | |
| 2005/0101461 | A1 * | 5/2005 | Johnson | 482/141 |
| 2005/0209054 | A1 * | 9/2005 | Thomas Lebert | 482/41 |

* cited by examiner

*Primary Examiner*—Lori Amerson
(74) *Attorney, Agent, or Firm*—Charles S. Knobloch; Arnold & Knobloch, L.L.P.

(57) ABSTRACT

A device and methods for assisting a person in body strengthening, stretching, or exercising. One or more base units of particular ratio of dimensions are provided, each having a horizontal bar for use in performing strength and exercise assistance to the user. Owing to their ratio of dimensions, the base units may be placed and oriented to each other in multiple configurations.

7 Claims, 8 Drawing Sheets

STRENGTH ASSISTANT DEVICE AND METHODS

FIELD OF THE INVENTION

The present invention relates generally to a device and methods for assisting a person in body strengthening, stretching, or exercising.

BACKGROUND OF THE INVENTION

Most exercising devices assume the person exercising has full control of their muscles and body members, such as their hands. Push up bars tend to be smaller and of design different from the present invention. Dip devices typically are of a fixed width, many requiring attachment to multiple station exercise assemblies. Gymnastic and physical therapy horizontal bars tend to be of lager size with non-adjustable fixtures, sized for use in large sports gym or institutional settings. Various devices attempt to address the issue of developing core body strength. Core body strength refers to the neck, upper back, and lower back. People with core body strength have better posture and are less likely to injure themselves. Core body strengthening often prevents or treats back and neck pain. Core body strength exercises are commonly performed by using weight training machines, bands, or floor mat exercises.

BRIEF SUMMARY OF THE INVENTION

What I am about to describe here is a new way to use a set of manual exercise strength assistant units to develop upper body strength, core body strength and lower body strength through a series of movements. The device, in combination with placement of the body, provides physical feedback to ensure movements are performed accurately for achieving the greatest strengthening in a short amount of time and repetitions. The body movements using the strength assistant units produce systemic muscular trauma both in a direct and ancillary way, such that muscle strength is significantly improved within an efficient time envelope.

The strength assistant units have an adjustable height on the main horizontal bar for use when sitting down in a chair or wheelchair.

The strength assistant units may be disassembled for ease in transportation and storage.

The dimensions of the strength assistant units are engineered such that they may be oriented in various ways relative to each other, providing a selection of methods of use and application.

Selection of orientation of the strength assistant units, in combination with a selected body movement, allows the user to address a specific physical condition or portion of body requiring physical attention. Required usage may be as little as five to ten minutes per day for certain movements using particular strength assistant unit orientations.

BRIEF SUMMARY OF THE INVENTION—OBJECTS AND ADVANTAGES

It is an object of the present invention to help people to improve body movement, leading to healthier living. Furthermore, the present invention helps people to stretch their body and build upper and core body strength for everyday normal life uses, including pulling, lifting, carrying, moving, and gripping. People able to stand up may also build strength in their hips and legs.

One advantage of the present invention is that a person may exercise in a private place, such as in their hotel room, to achieve strength improvement while at the same time achieving heart rate and lung exercise. The present invention is easily transportable for the traveling business person who has limited time to exercise.

Another object and advantage of the present invention is that people may achieve a full workout with a single device instead of having to purchase multiple machines or work out at an expensive fitness center.

The methods of use when applying the present invention allows for an exercise regimen that reduces the time per day for exercise to as little as five to ten minutes per day, three times per week.

The present invention allows exercise in a limited physical space, requiring a space as little as approximately five feet width by an individual's body length.

The present invention eliminates any calculations of selection for weight, height, tension strength or any other variable in strength development typically found with weights or exercise machines. Adjustment for body dimensions is achieved by placement and orientation of the two strength assistant units, whose critical fixed dimensions are any established in the unit. This subtly allows the user to use their own body measurements, such as body width, as a ruler to orient and place the units.

The present invention is light-weight and easy to position and set up for all body sizes, types and strengths. The present invention may be constructed of light-weight aluminum tubing that is easily assembled, disassembled and moved.

The present invention fits nearly all users who have natural use of hands and wrists, regardless of existing strength condition, size, weight, width, gender or age.

The present invention is adaptable for use by people who use wheelchairs or can only exercise in a seated position, such as disabled people. The present invention provides an adjustable height for use in either seated or reclined positions.

The present invention, using a person's own body weight and force resistance, provides kinesthetic feedback to the user to ensure proper usage.

The methods of use when applying the present invention allow movements designed either for near-full body weight via elevation at feet, or for significantly reduced body weight to accommodate weaker users, via elevation at the knees.

The present invention is suitable for use in a wide variety of applications, including, but not limited to: a home exercise regimen; meeting the limited time requirements for the busy traveler who still wants to exercise; enhancing the amateur and professional athlete in all sports including as football, baseball, tennis, basketball, hockey, weight lifting, wrestling and many others; meeting the needs for law enforcement, fire and rescue and military conditioning to achieve or maintain strength, stamina and endurance either during on duty condition or in a rough environment where normal exercise equipment or fitness facilities are unavailable; helping people undergoing physical therapy to continue with at home stretching and light strengthening movements; and helping senior citizens to increase core strength, which is what the Center for Disease Control calls the most important exercise process after age fifty-five.

The present invention may also be used as a lift assistant device for transferring people with limited mobility from a chair, toilet or bed. The present invention may be used as a lift assistant device for people who have trouble getting up film a seated position. The present invention may be used to build leg or lower back strength at home following physical therapy.

The present invention provides a variety of results, including, but not limited to: noticeable body or strength changes in less than two hours use of the product spread over a one month period; development of back, shoulders, chest, upper and lower arms in major muscle groups in a limited time frame; noticeable improvement in carrying, pulling, lifting strength, such as when carrying boxes and grocery bags, moving firewood, opening jars; and less fatigue and less sleepiness after a full day's activity.

The present invention is convenient to set up and store. The present invention may be set up and ready for use in a minute or two. The present invention has a small storage footprint, approximately two foot by two foot when fully assembled and even smaller when disassembled.

BRIEF DESCRIPTION OF THE SEVERAL VIEWS OF THE DRAWING

The present invention and its advantages will be better understood by referring to the following detailed description and the attached drawings in which.

REFERENCE NUMERALS IN DRAWINGS

Figure 1:
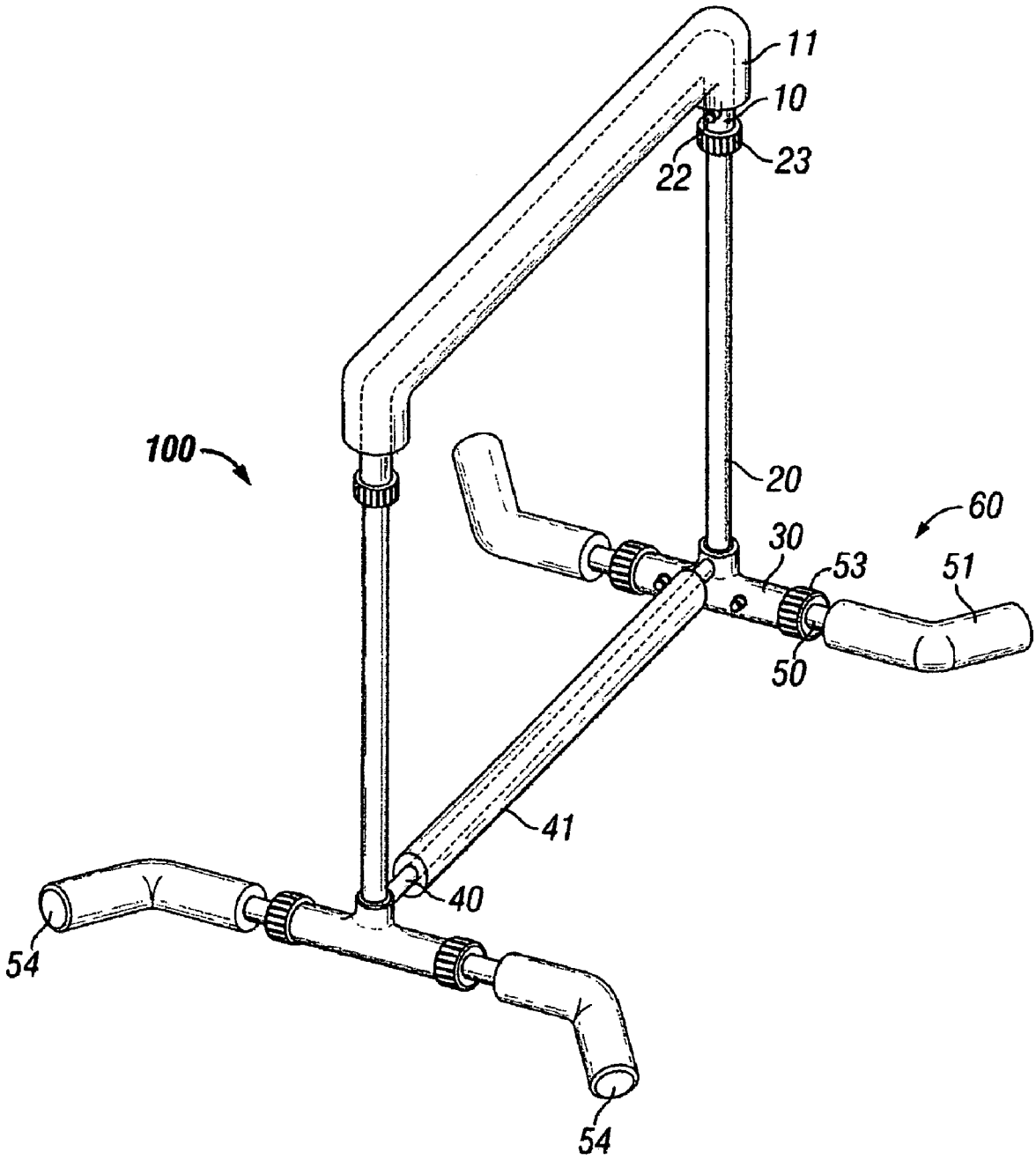
FIG. 1 shows a 3-D perspective view of one unit of the strength assistant apparatus.

The following elements are numbered as described in the drawings and detailed description of the invention:

| | |
|---|---|
| 10 horizontal grip feedback bar | 11 grip padding |
| 20 vertical member | 22 vertical member alignment pin |
| | 23 vertical member locking nut |
| 30 base | |
| 40 horizontal stabilizer bar | 41 stabilizer padding |
| 50 foot | 51 foot padding |
| | 52 foot alignment pin |
| | 53 foot locking nut |
| | 54 foot end cap |
| 60 base unit assembly | |
| 100 strength assistant unit | |

DETAILED DESCRIPTION OF THE INVENTION

The components showing one embodiment of the strength assistant unit 100 are illustrated in FIG. 1. A horizontal grip feedback bar 10 is the primary active surface a person will use to generate force resistance for exercise, stretching, or strength assistance. Horizontal grip feedback bar 10 may be a tube, pipe, or channel of approximately one inch to two and one-half inches (1.0" to 2.5") of thickness with ends fashioned to terminate at a right angle to its dominant longitudinal orientation. The ends of horizontal grip feedback bar 10 are bent at approximately right angles in the same plane and same direction, forming a shallow U-shape. Horizontal grip feedback bar 10 is approximately seventeen inches (17") long. Preferably, horizontal grip feedback bar 10 is at least partially sleeved along its dominant longitudinal orientation with grip padding 11. Grip padding 11 is at least approximately one-sixteenth inch (1/16") in thickness and may be of elastomeric or foam composition. As defined herein the term "elastomeric" refers to compositions capable of recovering size and shape after deformation. Alternatively, grip padding 11 may be embedded or integrated into the design of the surface of horizontal grip feedback bar 10. To insure attachment of the proper components in the proper orientation, alignment holes are uniquely positioned near the ends of horizontal grip feedback bar 10. The outside surfaces of the ends of horizontal grip feedback bar 10 are threaded to receive a locking nut, vertical member locking nut 23.

In an alternate embodiment, the width or shape of horizontal grip feedback bar 10 is fashioned to receive the palm of a user's hand, eliminating the need to grip with fingers. This is accomplished by providing an outer surface area on horizontal grip feedback bar 10 having approximately two inches (2") of width in the direction that is perpendicular to the dominant longitudinal orientation of horizontal grip feedback bar 10.

Vertical member 20 is a tube, pipe, or channel. Vertical member 20 is fashioned such that one end may be received into an end of horizontal grip feedback bar 10. A vertical member, alignment pin 22 is attached to a first end of vertical member 20. Vertical member alignment pin 22 is any of a variety of typical pin devices that lock into position when inserted into an alignment hole. Vertical member alignment pin 22 is positioned to align with the alignment hole of horizontal grip feedback bar 10 when vertical member 20 is properly positioned, rotated, and inserted into one end of horizontal grip feedback bar 10. Vertical member locking nut 23 is loosely fitted about vertical member 20. Vertical member locking nut 23 is any variety of typical compression fitting nuts that threadably attach, using a compression washer to achieve a friction fit. Many different similar attachment means or equivalents may be used. A first end of vertical member locking nut 23 has a larger diameter, to threadably attach to horizontal grip feedback bar 10, than the second end of vertical member locking nut 23, which conforms to the outer surface of vertical member 20. Vertical member 20 is inserted into vertical member locking nut 23 such that the first end of vertical member locking nut 23 is closer to the first end of vertical member 20 and the second end of vertical member locking nut 23 is closer to the second end of vertical member 20. Vertical member alignment pin 22 tends to prevent vertical member locking nut 23 from separating from vertical member 20. Vertical member locking nut 23 has a threaded inside surface for the purpose of attaching and securing to one threaded end of horizontal grip feedback bar 10. A second end of vertical member 20 is conformed to fit into a first opening of base 30.

Base 30 is a tube, pipe, or channel. A first opening is positioned at an intermediate distance between two ends, forming a T-shape. Optionally, a second opening may be positioned at a right angle to both the first opening and to the ends. The second opening may be used to receive a stabilizer bar. The first opening of base 30 is conformed to receive the second end of vertical member 20. Preferably, the second end of vertical member 20 is fitted into the first opening of base 30 and held fitted by friction or otherwise secured in place. Vertical member 20 and base 30 is typically provided pre-assembled. To insure attachment of the proper components in the proper orientation, alignment holes are uniquely positioned near the ends of base 30. The outside surfaces of the ends of base 30 are threaded to receive a locking nut, foot locking nut 53.

Foot alignment pin 52 is positioned to align with the alignment hole of base 30 when vertical foot 50 is properly positioned, rotated, and inserted into one end of base 30. Preferably, the alignment holes are positioned such that foot alignment pin 52 and vertical member alignment pin 22 may not be interchanged. This prevents accidental incorrect assembly of strength assistant unit 100.

Foot 50 is a V-shaped tube, pipe, or channel. Preferably, foot 50 is at least partially sleeved with foot padding 51. Foot padding 51 may be of elastomeric or foam composition. A foot alignment pin 52 is attached to a first end of foot 50. Foot alignment pin 52 is any of a variety of typical pin devices that lock into position when inserted into an alignment hole. Foot alignment pin 52 is positioned to align with the alignment hole of base 30 when foot 50 is properly positioned, rotated, and inserted into one end of base 30. Foot locking nut 53 is loosely fitted about foot 50. Foot locking nut 53 is any variety of typical compression fitting nuts that threadably attach, using a compression washer to achieve a friction fit. Many different similar attachment means or equivalents may be used. A first end of foot locking nut 53 has a larger diameter, to threadably attach to base 30, than the second end of foot locking nut 53, which conforms to the outer surface of foot 50. Foot 50 is inserted into foot locking nut 53 such that the first end of foot locking nut 53 is closer to the first end of foot 50 and the second end of foot locking nut 53 is closer to the second end of foot 50. Foot alignment pin 52 tends to prevent foot locking nut 53 from separating from foot 50. Foot locking nut 53 has a threaded inside surface for the purpose of attaching and securing to one threaded end of base 30. A second end of foot 50 receives foot end cap 54.

Foot 50 and base 30 are designed to provide approximately sixteen inches (16") of linear support that is both approximately perpendicular to vertical member 20 and approximately perpendicular to horizontal grip feedback bar 10. The remainder of V-shaped foot 50 extends, preferably at a sixty-sevens degree angle or at approximately a forty-five to ninety degree angle to the perpendicular of the major longitudinal direction of horizontal grip feedback bar 10, in an outward direction, away from the rest of the assembly, creating at least one laterally disposed weight bearing anchor point to the floor or ground. Typically, the resulting perpendicular extension of the end of foot 50 from the longitudinal orientation of base 30 is six inches (6").

Optionally, a horizontal stabilizer bar 40 may be attached between the two bases 30. Horizontal stabilizer bar 40 is friction mounted into a second opening of base 30.

Base unit assembly 60 comprises the two vertical members 20, two bases 30, four feet 50, and, optionally, horizontal stabilizer bar 40. Preferably, the distance between the respective second ends of diametrically opposed feet 50, forming a virtual line which crosses horizontal grip feedback bar 10, is approximately thirty-thee inches (33"). This represents a distance between respective second ends of adjacent feet 50, forming a virtual line approximately parallel to horizontal grip feedback bar 10, of approximately twenty nine inches (29"). This also represents a distance between respective second ends of adjacent feet 50, forming a virtual line approximately perpendicular to horizontal grip feedback bar 10, of approximately sixteen inches (16"). The ratio of distances may vary by up to approximately plus or minus twenty percent.

One strength assistant unit 100 comprises horizontal grip feedback bar 10 and base unit assembly 60. Strength assistant unit 100 is fabricated to support a minimum of two hundred pounds (200 lbs.) on horizontal grip feedback bar 10. The preferred total height from bottom of base 30 to top of horizontal grip feedback bar 10 is approximately eighteen inches (18"), but may be between approximately fourteen inches (14") and approximately thirty-two inches (32"), depending upon application.

Two strength assistant units 100 are used to perforce various strength assistant exercise, stretch, and body movement routines.

Strength assistant unit is assembled by attaching the second end of vertical member 20 to the first opening of base 30. A second vertical member 20 is likewise attached to a second base 30. Preferably, vertical member 20 is pre assembled to base 30 and may be permanently attached together. Optionally, the two bases 30 are connected together by inserting each end of horizontal stabilizer bar 40 into each respective second opening of bases 30.

Assembly continues by inserting vertical member alignment pin 22 of vertical member 20 into one end of horizontal grip feedback bar 10, rotating into the proper orientation until member alignment pin 22 locks into the alignment hole of grip feedback bar 10. Vertical member locking nut 23 is threaded onto the threaded end of horizontal grip feedback bar 10, securing vertical member 20 to horizontal grip feedback bar 10. The second vertical member 20 is inserted into the second end of horizontal grip feedback bar 10 using the same technique.

Assembly continues by inserting foot alignment pin 52 of foot 50 into one end of base 30, rotating into the proper orientation until foot alignment pin 52 locks into the alignment hole of base 30. V-shaped foot 50 will extend in an outward direction, in a plane that is both parallel to horizontal grip feedback bar 10 and perpendicular to vertical member 20, away from the rest of the assembly. Foot locking nut 53 is threaded onto the threaded end of base 30, securing foot 50 to base 30. A second foot is inserted into the other end of base 30 using the same technique. In a like manner, two feet 50 are attached to the second base 30.

In an alternate embodiment, base 30 is padded.

In another alternate embodiment, base assembly bases 30 and feet 50 are constructed as an integrated unit.

In another alternate embodiment, only feet 50 need be assembled onto the remainder of strength assistant 100.

In another alternate embodiment, base assembly bases 30 and feet 50 and vertical members 20 and horizontal grip feedback bar 10 are constructed as an integrated unit.

In another alternate embodiment, the total height from bottom of base 30 to top of horizontal grip feedback bar 10 is adjustable from approximately eighteen to thirty-two inches (18" to 32").

In another alternate embodiment, the total height from bottom of base 30 to top of horizontal grip feedback bar 10 is adjustable by selection of alternate vertical members 20 of alternate length.

Figure 2A:
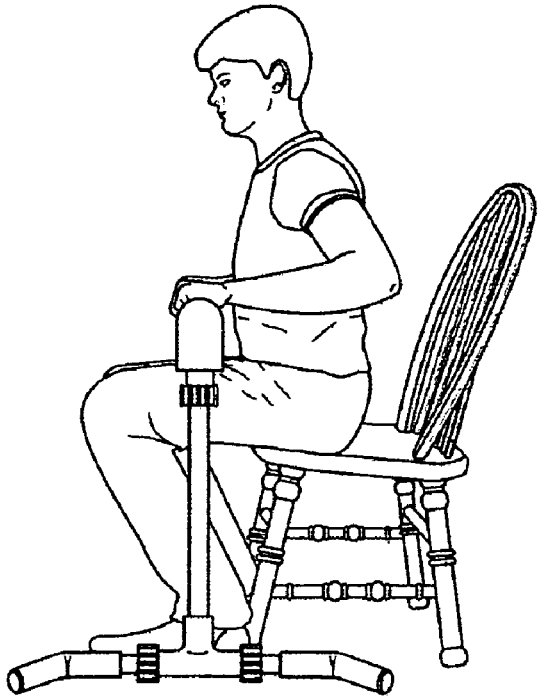
FIG. 2A shows a side view illustrating the use of one strength assistant unit 100 in a front single bar movement, with a seated person in a starting position.
Figure 2B:
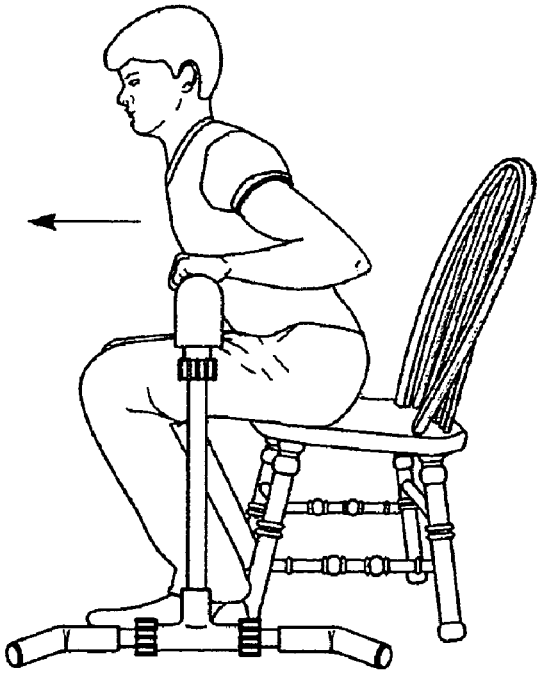
FIG. 2B shows a side view illustrating the use of one strength assistant unit 100 in a front single bar movement, with a once-seated person seated in a finishing position.

FIG. 2A shows a side view illustrating the use of one strength assistant unit 100 in a front single bar movement, within a seated user in a starting position. Strength assistant unit 100 is shown using a height of approximately thirty-two inches (32"); enabling a seated user to place their legs under horizontal grip feedback bar 10 when in the seated position. Base unit assembly 60 (as illustrated in FIG. 1) is sized such that a typical chair or wheelchair may fit between vertical members 20 (as illustrated in FIG. 1) causing the user to be automatically properly aligned and positioned relative to the strength assistant unit. Strength assistant unit 100 is oriented such that horizontal grip feedback bar 10 is over the person's knees with the major longitudinal direction of horizontal grip feedback bar 10 parallel to, and in front of, the chest or sternum of the user. The user places their palms on horizontal grip feedback bar 10. The user is in the proper starting position when the user's upper arm is approximately vertical and the user's forearm angled between zero and approximately thirty degrees (30 deg.) up from horizontal. The movement begins when the user uses their arms to pull, causing the user's body to bend at the user's waist and the user's chest to move forward, toward strength assistant unit 100. The user ultimately rests their chest on their hands such that the user's hands are now proximate to the user's armpits. This movement will tend to use muscles in the region of the user's shoulder blades, chest and arms. FIG. 2B shows a side view illustrating the use of one strength assistant unit 100 in the front single bar movement, with the once-seated user seated in a finishing position. In this example, the user's knees are typically bent and the user is now positioned relatively closer to strength assistant unit 100. The user's fore arm is now approximately horizontal and the user's upper arm angled approximately thirty to forty-five degrees (30-45 deg.) from vertical and extending laterally outward from the user's body. Base unit assembly 60 does not move or tip in reaction to the force applied by the user, owing to base unit assembly's structural footprint. The user may return to the starting position, taking care to not lock their elbows when pushing back to the starting position, thereby cycling back to the beginning of the movement. Typically, this movement is repeated ten times.

Figure 3A:
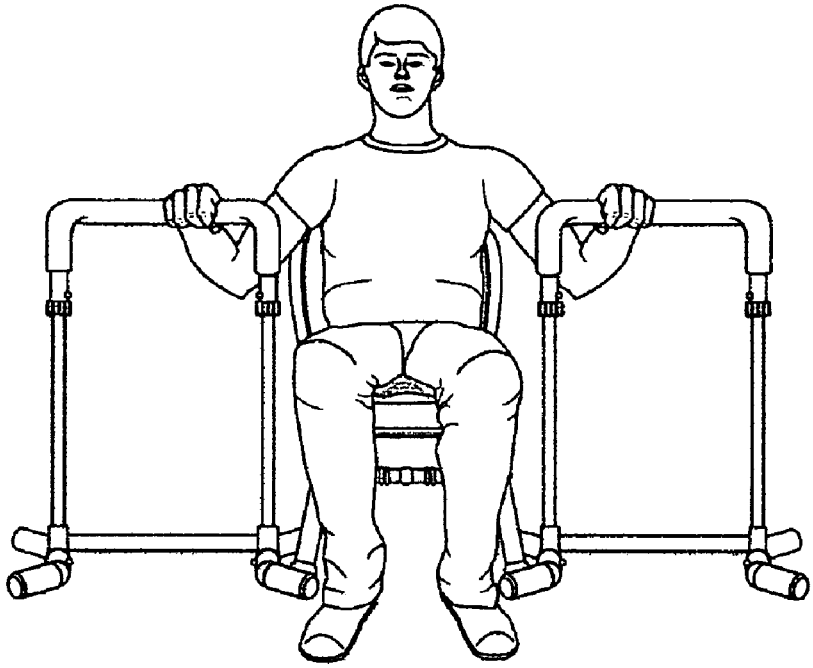
FIG. 3A shows a front view illustrating the use of two strength assistant units 100 in a double bar front movement, with a seated person in a starting position.
Figure 3B:
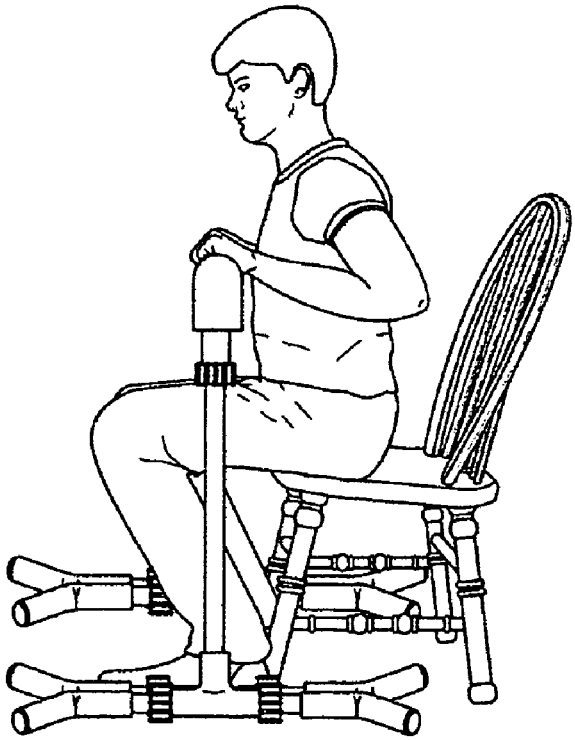
FIG. 3B shows a side view illustrating the use of two strength assistant units 100 in a double bar front movement, with a seated person in a sting position.
Figure 3C:
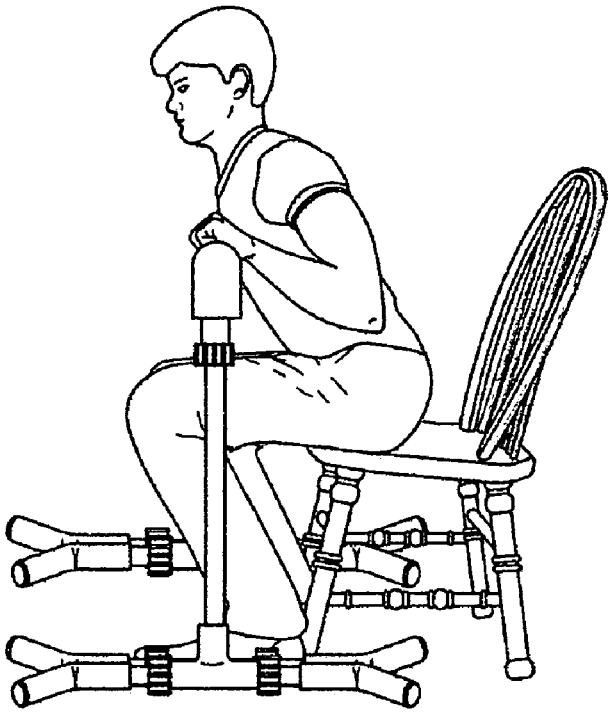
FIG. 3C shows a side view illustrating the use of two strength assistant units 100 in a double bar front movement, with a once-seated person in a finishing position.

FIG. 3A shows a front view illustrating the use of two strength assistant units 100 in a double bar front movement, with a seated user in a starting position. One strength assistant unit 100 is placed on each side of the seated user, with the major longitudinal direction of each respective horizontal grip feedback bar 10 aligned perpendicular to the facing direction of the user. The strength assistant units 100 typically are at a height of approximately thirty-two inches (32"). By placing the seated user in between and slightly behind the two strength assistant units 100, the user is automatically properly aligned and positioned relative to these strength assistant units. As illustrated, the user grips with each hand the respective horizontal grip feedback bar 10. FIG. 3B shows a side view illustrating the same double bar front movement, with the seated user in the starting position. Each strength assistant unit is positioned in front of the seated person such that the arms of the person extend slightly in front of the person's torso to grip each respective horizontal grip feedback bar 10. Typically, each of the strength assistant units 100 is the same distance in front of the user, forming a virtual line between the person's two palms. The user then uses their arms to pull their torso forward toward the virtual line, bending at the user's waist, such that the user's chest reaches past the horizontal grip feedback bars, as shown in FIG. 3C. FIG. 3C shows a side view illustrating the same double bar front movement, with the seated person in the finishing position.

Figure 3D:
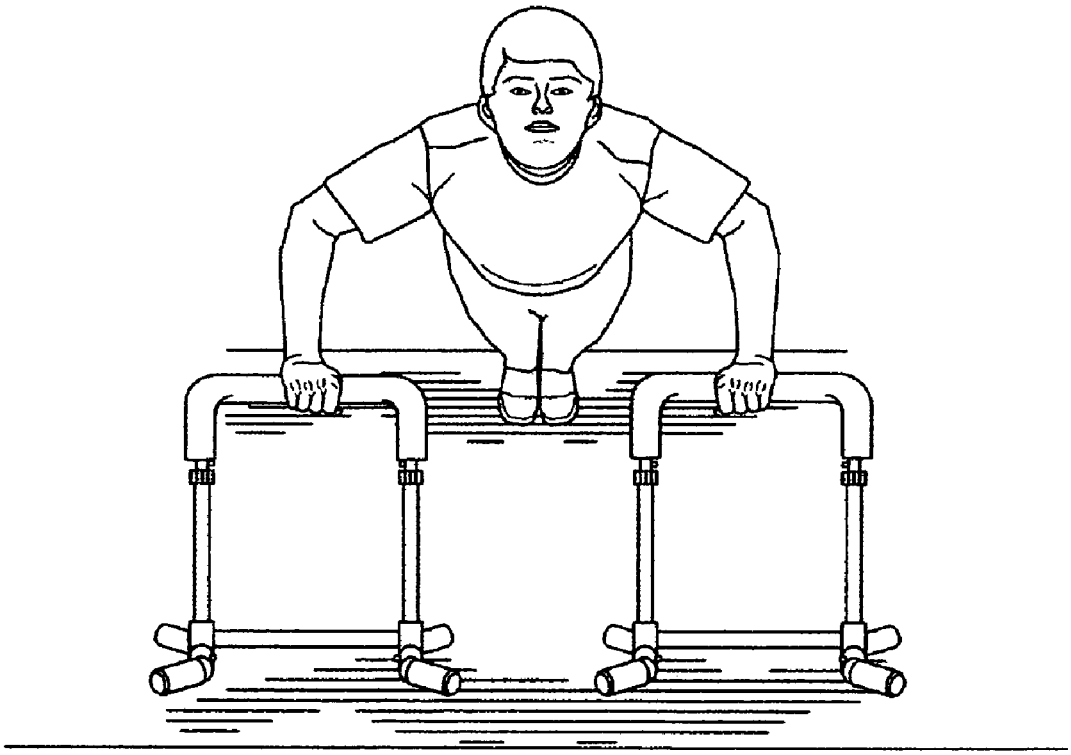
FIG. 3D shows a front view illustrating the use of two strength assistant units 100 in a double bar front movement, with a person in a sting position.
Figure 3E:
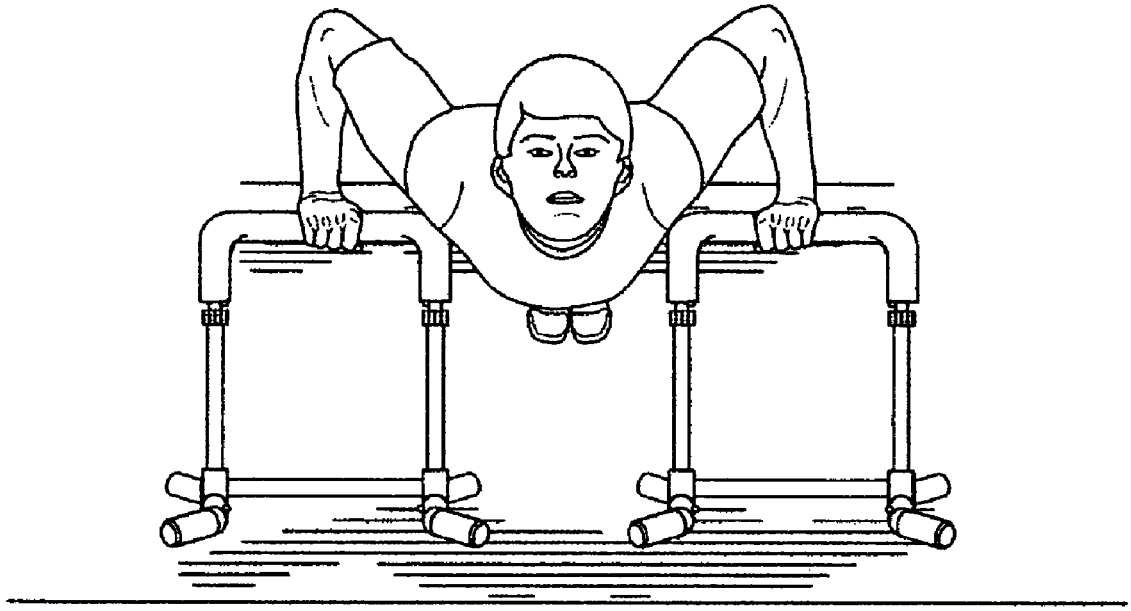
FIG. 3E shows a front view illustrating the use of two strength assistant units 100 in a double bar front movement, with a person in a finishing position.

FIG. 3D shows a front view illustrating the use of two strength assistant units 100 in a double bar front movement, with a user in an unseated starting position. One strength assistant unit 100 is placed on each side of the user, with the major longitudinal direction of each respective horizontal grip feedback bar 10 aligned perpendicular to the facing direction of the user. The ends of the feet of each strength assistant unit may nearly touch, creating an opening of approximately eleven inches (11"), representing a proper distance for smaller bodied users, such as women of size 2 to 4, teenagers, or men of jacket size 34 to 36. The strength assistant units 100 are shown using a height of approximately eighteen inches (18"). In this embodiment, the user assumes push-up body position, placing their feet behind the strength assistant units with their hands gripping each respective horizontal grip feedback bar 10. This is accomplished by the user first resting on their knees. The user then grips the horizontal grip feedback bars, each hand gripping towards the proximate end of each respective horizontal grip feedback bar. The user then extends their feet backward, lifting their knees off the floor. The user's feet, toes, and hands now bear the user's weight. This results in the user's body to be positioned as an inclined plane from the ground, with the user's feet acting as a fulcrum. The user then lowers their torso downward, bending their elbows. As the user's torso approaches a finishing position, extending slightly below the height of the horizontal grip feedback bars, the user may be able to extend their thumbs to touch the sides of their torso. FIG. 3E shows a front view illustrating the use of two strength assistant units 100 in a double bar front movement, with the user in a finishing position. This double bar front movement enables the user to stretch and strengthen their chest muscles, arms, back, abdomen and sides. Alternatively, the user may perform this movement using their knees as a fulcrum (not illustrated), rather than their feet and toes. Typically, a user will train until the user is able to accomplish repeating three sets of this movement, each set comprising repeating this movement ten times. Once a user accomplishes this movement using their knees as a fulcrum, the user may progress to using their feet and toes as a fulcrum.

Figure 4A:
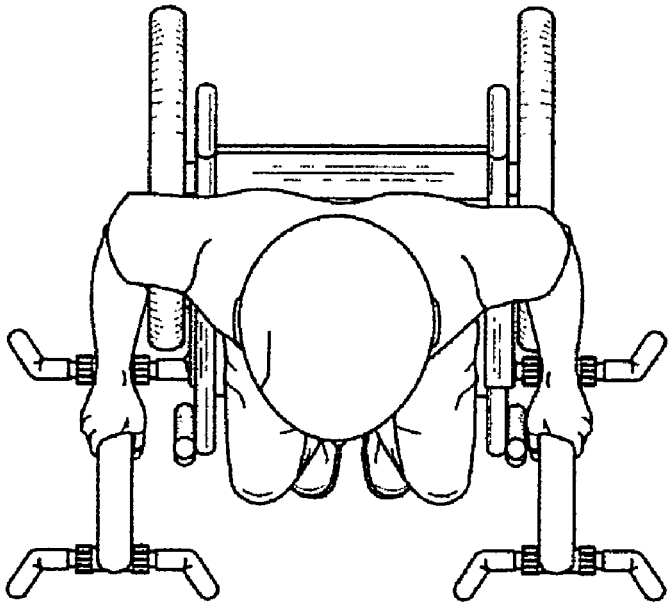
FIG. 4A shows a top view illustrating the use of two strength assistant units 100 in a double bar to side movement, with a seated person in a starting position.
Figure 4B:
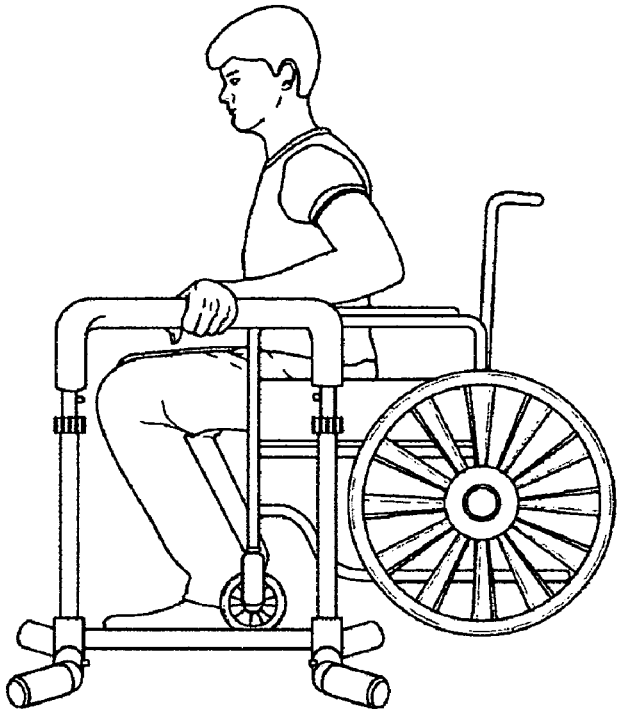
FIG. 4B shows a side view illustrating the use of two strength assistant units 100 in a double bar side movement, with a seated person in a starting position.
Figure 4C:
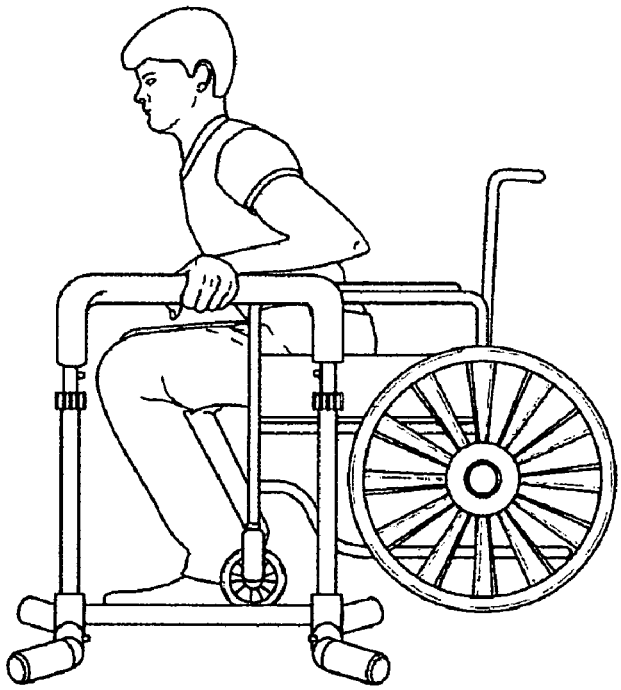
FIG. 4C shows a side view illustrating the use of two strength assistant units 100 in a double bar side movement, with a once-seated person in a finishing position.

FIG. 4A shows a top view illustrating the use of two strength assistant units 100 in a double bar side movement, with a seated user in a staring position. A wheelchair is used here to illustrate one method of seating for this movement. One strength assistant unit 100 is placed on each side of the seated user, with the major longitudinal direction of each respective horizontal grip feedback bar 10 aligned parallel to the facing direction of the user. Typically, the user grips with their hands in front of their torso at a location about one third to one half of the distance from the far end of each respective horizontal grip feedback bar 10. FIG. 4B shows a side view illustrating the same double bar side movement, with the seated user in the starting position. The strength assistant units 100 typically are at a height of approximately thirty-two inches (32"). The user is in the proper starting position when the user's upper arm is approximately horizontal and extended away from the user's torso and the user's fore arm angled between zero and approximately thirty degrees (30 deg.) up from horizontal. The user then uses their arms to pull their torso forward toward their hands, bending at the waist, as shown in FIG. 4C. This movement results in the user's upper arm stretching further behind the user's torso and user's fore arm squeezing against the user's biceps, forming an oblique angle between the fore arm and upper arm. FIG. 4C shows a side view illustrating the double bar side movement, with the seated person in a finishing position.

Figure 4D:
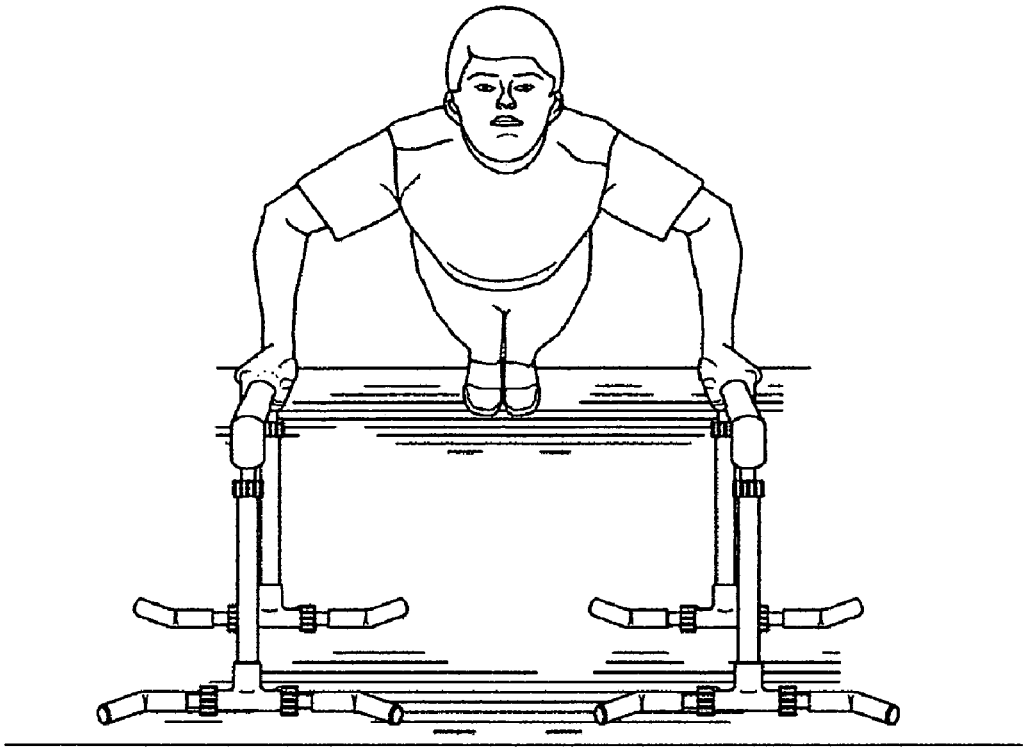
FIG. 4D shows a front view illustrating the use of two strength assistant units 100 in a double bar side movement, with a person in a starting position.
Figure 4E:
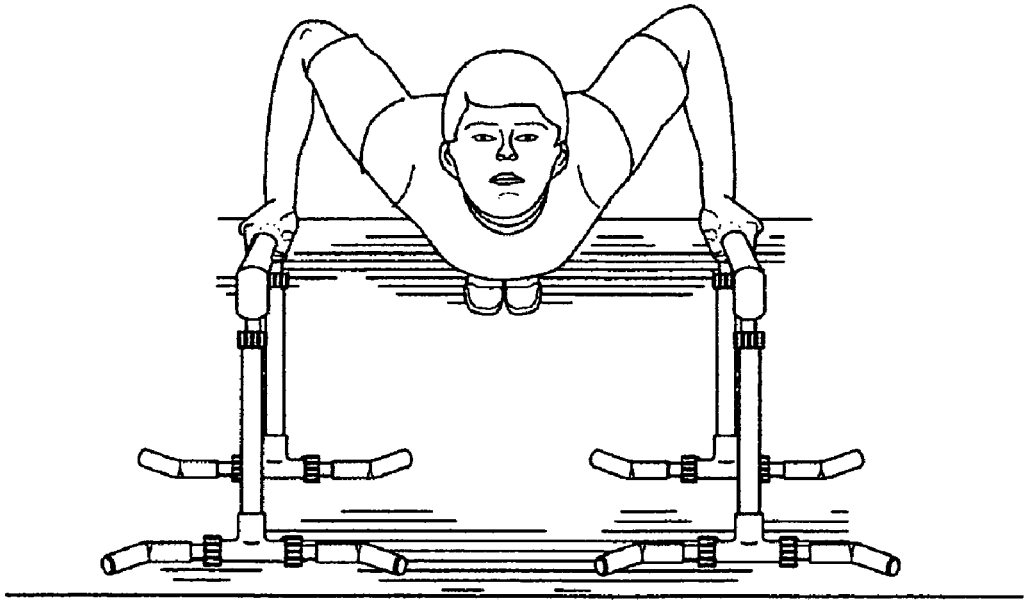
FIG. 4E shows a front view illustrating the use of two strength assistant units 100 in a double bar side movement, with a person in a finishing position.

FIG. 4D shows a front view illustrating the use of two strength assistant units 100 in a double bar side movement, with a user in an unseated starting position. One strength assistant unit 100 is placed on each side of the user, with the major longitudinal direction of each respective horizontal grip feedback bar 10 aligned parallel to the facing direction of the user. The ends of the feet of each strength assistant unit may nearly touch, creating an opening of approximately fourteen and one-half inches (14½"), representing a proper distance for smaller bodied users, such as women of size 2 to 4, teenagers, or men of jacket size 34 to 36. The strength assistant units 100 are shown using a height of approximately eighteen inches (18"). In this embodiment, the user assumes a push-up body position, placing their feet behind the strength assistant units with their hands gripping each respective horizontal grip feedback bar 10. This is accomplished by the user first resting on their knees. The user then grips the horizontal grip feedback bars, each hand gripping towards the proximate end of each respective horizontal grip feedback bar. The user's wrists should be approximately aligned with the user's armpits. The user then extends their feet backward, lifting their knees off the floor. The user's feet, toes, and hands now bear the user's weight. This results in the user's body to be positioned as an inclined plane from the ground, with the user's feet acting as a fulcrum. The user then lowers their torso downward, bending their elbows. As the user's torso approaches a finishing position, extending slightly toward the height of the horizontal grip feedback bars, the user may be able to extend their thumbs to touch the sides of their torso. During this movement, the user should attempt to keep their elbows tucked close to their body as the body is lowered towards the finishing position. The user may return to the starting position, taking care to not lock their elbows when pushing back to the starting position, thereby cycling back to the beginning of the movement. FIG. 4E shows a front view illustrating the double bar side movement, with the unseated user in a fishing position. Alternatively, the user may perform this movement using their knees as a fulcrum (not illustrated), rather than their feet and toes. Typically, a user will train until the user is able to accomplish repeating three sets of this movement, each set comprising repeating this movement ten times. Once a user accomplishes this movement using their knees as a fulcrum, the user may progress to using their feet and toes as a fulcrum.

Figure 5A:
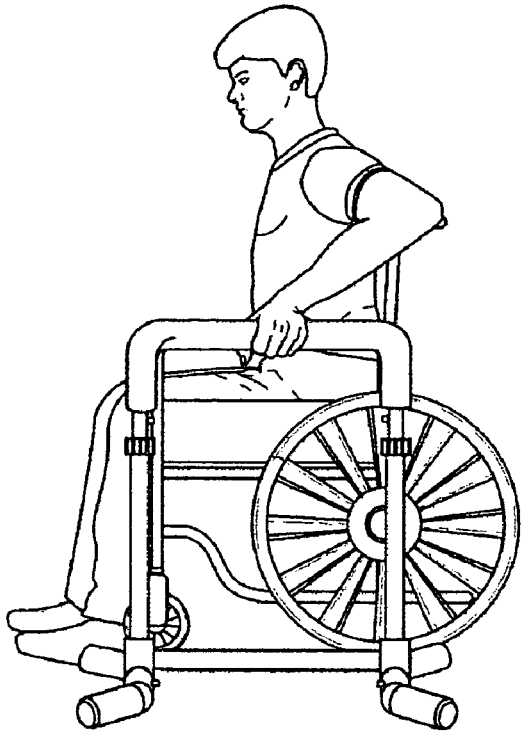
FIG. 5A shows a side view illustrating the use of two strength assistant units 100 in a double bar reverse movement, with a person in a seated starting position.
Figure 5B:
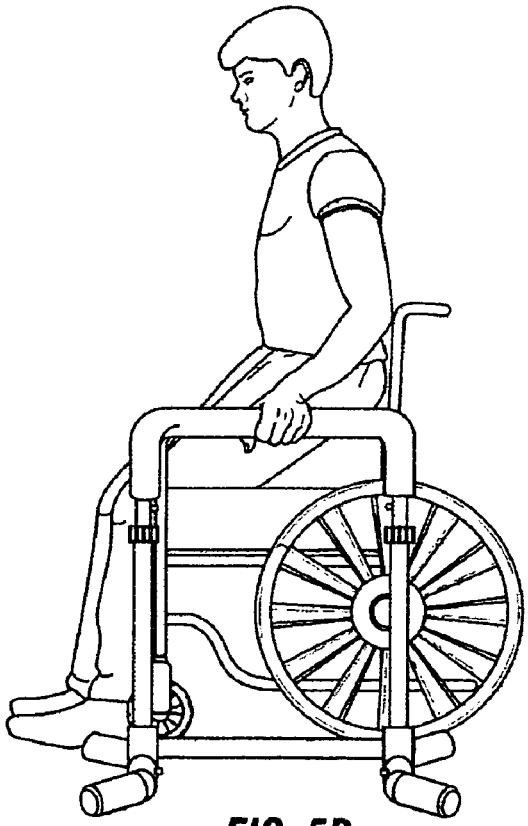
FIG. 5B shows a side view illustrating the use of two strength assistant units 100 in a double bar reverse movement, with a once-seated person in a finishing position.

FIG. 5A shows a side view illustrating the use of two strength assistant units 100 in a double bar reverse movement, with a seated user in a starting position. For clarity, only the front strength assistant unit 100 is illustrated. The strength assistant units 100 typically are at a height of approximately thirty-two inches (32"). A wheelchair is used here to illustrate one method of seating for this movement. One strength assistant unit 100 is placed on each side of the seated user, with the major longitudinal direction of each respective horizontal grip feedback bar 10 aligned parallel to the facing direction of the user. Typically, the user grips with their hands in near their torso at a location about approximately one half of the distance from the ends of each respective horizontal grip feedback bar 10. The user is in the proper starting position when the user's upper arm is approximately horizontal and extended behind the user's torso and the user's fore arm angled between zero and approximately thirty degrees (30 deg.) down from horizontal. The user then uses their aims to push their torso up, extending both their upper arm and fore arm towards a fully vertical orientation. FIG. 5B shows a side view illustrating the use of two strength assistant units 100 in a double bar reverse movement, with the user approaching a finishing position.

The double bar reverse movement may also be practiced by a user who is not in a seat (not illustrated). Typically, strength assistant units 100 of a height of approximately eighteen inches (18") are used. One strength assistant unit 100 is placed on each side of the squatting user, with the major longitudinal direction of each respective horizontal grip feedback bar 10 aligned parallel to the facing direction of the user. Typically, the strength assistant units are placed slightly further apart than when practicing the double bar side movement, allowing the user to lower their hips below the horizontal grip feedback bars 10. Typically, the user grips with their hands at their side and aligned close to their torso at a location about approximately one half of the distance from the ends of each respective horizontal grip feedback bar 10. The user should be able to extend their thumbs to touch the sides of their torso. The user may be sitting with their legs extended horizontally in front of their torso, or, alternatively, may lift their legs to extend horizontally in front of their torso. The user is in the proper starting position when the user's upper arm is approximately horizontal and extended behind the user's torso and the user's fore arm angled down from horizontal. The user then uses their arms to push their torso up, extending both their upper arm and fore arm towards a fully vertical orientation. Alternatively, the user may apply a squat position by placing their feet flat on the ground rather than extending the legs horizontally. The user should tilt their head to look up at approximately a forty-five degree (45 deg.) angle from horizontal in order to avoid neck strain.

Although the description above contains many specifications, these should not be construed as limiting the scope of the invention but as merely providing illustrations of some of the presently preferred embodiments of this present invention. Persons skilled in the art will understand that the method and apparatus described herein may be practiced, including but not limited to, the embodiments described. Further, it should be understood that the invention is not to be unduly limited to the foregoing which has been set forth for illustrative purposes. Various modifications and alternatives will be apparent to those skilled in the art without departing from the true scope of the invention, as defined in the following claims. While there have been illustrated and described particular embodiments of the present invention, it will be appreciated that numerous changes and modifications will occur to those skilled in the art, and it is intended in the appended claims to cover those changes and modifications which fall within the true spirit and scope of the present invention.

What is claimed is:

1. A strength assistance device comprising:

a horizontal grip feedback bar having ends terminating at a right angle to the dominant longitudinal orientation of said feedback bar, wherein said ends bend at approximately right angles in the same plane and same direction, whereby a shallow U-shape having a length of approximately seventeen inches in the dominant longitudinal orientation of said horizontal grip feedback bar is formed;

grip padding disposed at least partially along the dominant longitudinal orientation of said horizontal grip feedback bar, wherein said grip padding comprises an elastometric foam having approximately one sixteenth inch (1/16') in thickness;

alignment holes disposed near the ends of said horizontal grip feedback bar;

threading disposed on the outside surfaces of said ends of said horizontal grip feedback bar for receiving a vertical member locking nut;

a first vertical member having a first end conformed to be received into a first end of said horizontal grip feedback bar and further having a second end, said first vertical member further comprising:

a first vertical member alignment pin attached to a first end of said first vertical member, positioned to align with said alignment hole proximate to said first end of said horizontal grip feedback bar; and a first vertical member locking nut, having a threaded inside surface, said first vertical member locking nut disposed about said first vertical member, whereby said first vertical member locking nut is attachable to said first threaded end of said horizontal grip feedback bar;

a first base comprising:

a first threaded end and a second threaded end;

a first alignment hole positioned near said first end;

a second alignment hole positioned near said second end;

a first opening positioned at an intermediate distance between said first end and said second end, whereby a T-shape is formed; and wherein said second end of said first vertical member is conformed to fit into said first opening of said first base;

a first foot having a V-shape with an internal angle approximately between ninety degrees and one hundred thirty-five degrees, further comprising:

a first end conformed to be received into said first end of said first base;

a second end;

a first foot alignment pin attached to said first end of said first foot, wherein said first foot alignment pin is positioned to align with said first alignment hole proximate to said first end of said first base; and a first foot locking nut, having a threaded inside surface, said first foot locking nut disposed about said first foot, whereby said first foot locking nut is attachable to said first threaded end of said first base;

a second foot having a V-shape with an internal angle approximately between ninety degrees and one hundred thirty-five degrees, further comprising:

a first end conformed to be received into said second end of said first base;

a second end;

a second foot alignment pin attached to said first end of said second foot, wherein said second foot alignment pin is positioned to align with said second alignment hole proximate to said second end of said first base; and a second foot locking nut, having a threaded inside surface, said first foot locking nut disposed about said second foot, whereby said second foot locking nut is attachable to said second threaded end of said first base;

a second vertical member having a first end conformed to be received into a second end of said horizontal grip feedback bar and further having a second end, said second vertical member further comprising:

a second vertical member alignment pin attached to a first end of said second vertical member, positioned to align with said alignment hole proximate to said second end of said horizontal grip feedback bar; and a second vertical member locking nut, having a threaded inside surface, said second vertical member locking nut disposed about said second vertical member, whereby said second vertical member locking nut is attachable to said second threaded end of said horizontal grip feedback bar;

a second base comprising:

a first threaded end and a second threaded end;

a first alignment hole positioned near said first end;

a second alignment hole positioned near said second end;

a first opening positioned at an intermediate distance between said first end and said second end, whereby a T-shape is formed; and wherein said second end of said second vertical member is conformed to fit into said first opening of said second base;

a third foot having a V-shape with an internal angle approximately between ninety degrees and one hundred thirty-five degrees, further comprising:

a first end conformed to be received into said first end of said second base;

a second end;

a third foot alignment pin attached to said first end of said third foot, wherein said third foot alignment pin is positioned to align with said first alignment hole proximate to said first end of said second base; and a third foot locking nut, having a threaded inside surface, said third foot locking nut disposed about said third foot, whereby said third foot locking nut is attachable to said first threaded end of said second base; and a fourth foot having a V-shape with an internal angle approximately between ninety degrees and one hundred thirty-five degrees, further comprising:

a first end conformed to be received into said second end of said second base;

a second end;

a fourth foot alignment pin attached to said first end of said fourth foot, wherein said fourth foot alignment pin is positioned to align with said second alignment hole proximate to said second end of said second base; and a fourth foot locking nut, having a threaded inside surface, said first foot locking nut disposed about said fourth foot, whereby said fourth foot locking nut is attachable to said second threaded end of said second base.

2. The strength assistance device of claim 1 wherein:

said first base further comprises a second opening positioned at a right angle to both said first opening and said first and second ends;

said second base further comprises a second opening positioned at a right angle to both said first opening and said first and second ends; and further comprising:

a stabilizer bar having a first end fitted into said second opening of said first base and having a second end fitted into said second opening of said second base.

3. The strength assistance device of claim 1 wherein said alignment holes are positioned such that said foot alignment pins and said vertical member alignment pins may not be interchanged.

4. The strength assistance device of claim 1 wherein:

said first base and said first foot and said second foot are constructed as an integrated unit; and said second base and said third foot and said fourth foot are constructed as an integrated unit.

5. The strength assistance device of claim 1 wherein said first base and said second base and said first vertical member and said second vertical member and said horizontal grip feedback bar are constructed as an integrated unit.

6. The strength assistance device of claim 1 wherein:

the combined length of said feet and said bases is approximately twenty nine inches along the dominant longitudinal orientation of said horizontal grip feedback bar; and the combined width of said feet and said bases is approximately sixteen inches perpendicular to the dominant longitudinal orientation of said horizontal grip feedback bar.

7. The strength assistance device of claim 1 wherein the ratio of the combined length of the feet and bases along the dominant longitudinal orientation of said horizontal grip feedback bar to the combined width of the feet and bases perpendicular to the dominant longitudinal orientation of said horizontal grip feedback bar is between 2.175:1.00 and 1.45:1.00.

* * * * *